US006557813B1

(12) United States Patent
Duggan

(10) Patent No.: US 6,557,813 B1
(45) Date of Patent: May 6, 2003

(54) DEVICE FOR HANGING AN OBJECT ON A WALL

(76) Inventor: Brian Duggan, 18 Westbourne Lodge, Knocklyon, Dublin 16 (IE)

( * ) Notice: Subject to any disclaimer, the term of this patent is extended or adjusted under 35 U.S.C. 154(b) by 0 days.

(21) Appl. No.: 10/009,046

(22) PCT Filed: Jun. 9, 2000

(86) PCT No.: PCT/IE00/00076

§ 371 (c)(1),
(2), (4) Date: Dec. 6, 2001

(87) PCT Pub. No.: WO00/74539

PCT Pub. Date: Dec. 14, 2000

(30) Foreign Application Priority Data

Jun. 9, 1999 (IE) ..... S990479

(51) Int. Cl.[7] ..... A47G 1/24
(52) U.S. Cl. ..... 248/476; 248/495; 248/496
(58) Field of Search ..... 248/476, 466, 248/475.1, 477, 478, 489, 493, 495, 496

(56) References Cited

U.S. PATENT DOCUMENTS 445,942 A * 2/1891 Siddall ..... 248/495
779,433 A * 1/1905 Long ..... 248/495
1,908,200 A * 5/1933 Webster ..... 248/495
2,569,622 A * 10/1951 Trainor ..... 248/477
2,723,096 A * 11/1955 Schwartz ..... 248/495
2,740,603 A * 4/1956 Wofford ..... 248/494
3,294,355 A * 12/1966 Topf ..... 248/467
3,945,599 A * 3/1976 Spier et al. ..... 248/476
4,611,780 A * 9/1986 Robertson ..... 248/477
4,712,761 A * 12/1987 Wassell ..... 248/475.1
4,892,284 A * 1/1990 Kelrick ..... 248/476
5,342,014 A * 8/1994 Wilson ..... 248/476
5,584,462 A * 12/1996 Reese ..... 248/477
5,878,987 A * 3/1999 Hayde ..... 248/477
6,003,825 A * 12/1999 Abernathy, Jr. ..... 248/478

* cited by examiner

*Primary Examiner*—Anita King
(74) *Attorney, Agent, or Firm*—Porter, Wright, Morris & Arthur LLP

(57) ABSTRACT

A device for hanging an object on a wall comprises a vertical guide (22) and a horizontal rail (44) mounted on a body (30) which is adjustable up and down the guide. A further horizontal rail (46) may be slid horizontally along the rail (44). In use the guide (22) is fixed to the wall and the rail (46) is fixed horizontally to the back of a picture of other article to be hung. The position of the article is adjusted by sliding the body (30) in the guide (22) and/or the rail (46) along the rail (44).

4 Claims, 4 Drawing Sheets

10
12
14
16
18
20
22
24
26
28
30
32
34
38
40
42
44
46

DEVICE FOR HANGING AN OBJECT ON A WALL

TECHNICAL FIELD

This invention relates to a device for hanging an object, such as a picture, on a wall.

BACKGROUND ART

The commonest method of hanging pictures is to hammer a nail or a picture hook into the wall and hang the picture from this using a length of wire or cord attached to the picture, usually by means of two screw eyes. Alternatively, some pictures come with a metal plate fixed centrally at the rear. The plate has a locating hole or locating teeth which directly engage the nail or hook.

A disadvantage with these methods is that it is difficult to hang several pictures in a straight line and to group pictures evenly. If one is not satisfied with the way a picture is hanging, one has to remove the hook or nail and reposition it, and/or adjust the length of the wire or cord. Also, even after they have been properly adjusted, pictures often go crooked.

It is an object of the invention to provide a device which overcomes or mitigates these disadvantages.

DISCLOSURE OF THE INVENTION

According to the present invention there is provided a device for hanging an object on a wall, the device comprising a first component for mounting on a wall, a second component for engaging the first component and being adjustable thereon along a first direction, and a third component for engaging the second component and being adjustable thereon along a second direction substantially normal to the first direction, the object being attached in use to the third component.

BRIEF DESCRIPTION OF THE DRAWINGS

Embodiments of the invention will now be described, by way of example, with reference to the accompanying drawings, in which.

DISCLOSURE OF PREFERRED EMBODIMENTS

Referring to FIGS. 1 to 7, a device for hanging a picture on a wall comprises a first component 10, a second component 12 and a third component 14.

Figure 7:
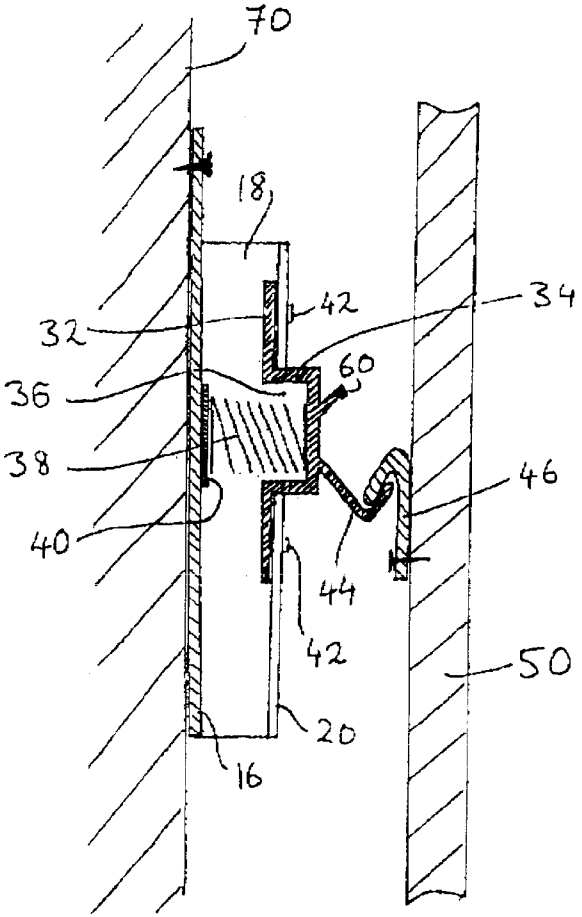
FIG. 7 is a sectional side view of the device of FIG. 1 when assembled and supporting a picture.

The first component 10 comprises a back plate 16 for securing flat against a wall 70, FIG. 7, on which a picture is to be hung. A pair of substantially parallel side walls 18 extend forwardly from opposite edges of the back plate 16, and a pair of front walls 20 extend from the forward edges of the side walls 18 towards one another substantially parallel to the back plate 16. The back plate 16, side walls 18 and front walls 20 together define a shallow channel 22 of substantially constant rectangular cross-section, the channel having a longitudinal slot 24 of restricted width facing away from the back plate 16. As will be described, the channel 22 serves as a guide for a member 30.

Holes 26 in the back plate 16 allow the latter to be screwed or nailed to the wall and, in use, the back plate 16 is mounted on the wall with the channel 22 and, therefore, the slot 24 substantially vertical. This may be achieved by placing a spirit level against one of the side walls 18. Each front wall 20 has a series of evenly spaced holes 28 extending substantially parallel to the slot 24, each hole 28 in one front wall 20 being on the same horizontal level (when the base plate 16 is fixed to the wall as aforesaid) as a corresponding hole 28 in the other wall.

The second component 12 comprises a generally T-shaped member 30 including a substantially rectangular rear plate 32 and a forwardly projecting body 34. In use the plate 32 is slidably accommodated in the channel 22 with the body 34 projecting forwardly through the slot 24. The width of the plate 32 is substantially the same as the internal width of the channel 22, and/or the width of the body 34 is substantially the same as the width of the slot 24, so that the member 30 is guided for substantially vertical movement in the channel 22 without significant rocking from side-to-side. However, the thickness of the plate 32 is substantially less than the depth of the channel 22, so that the member 30 is able to move, within the channel, towards and away from the back plate 16.

Figure 1:
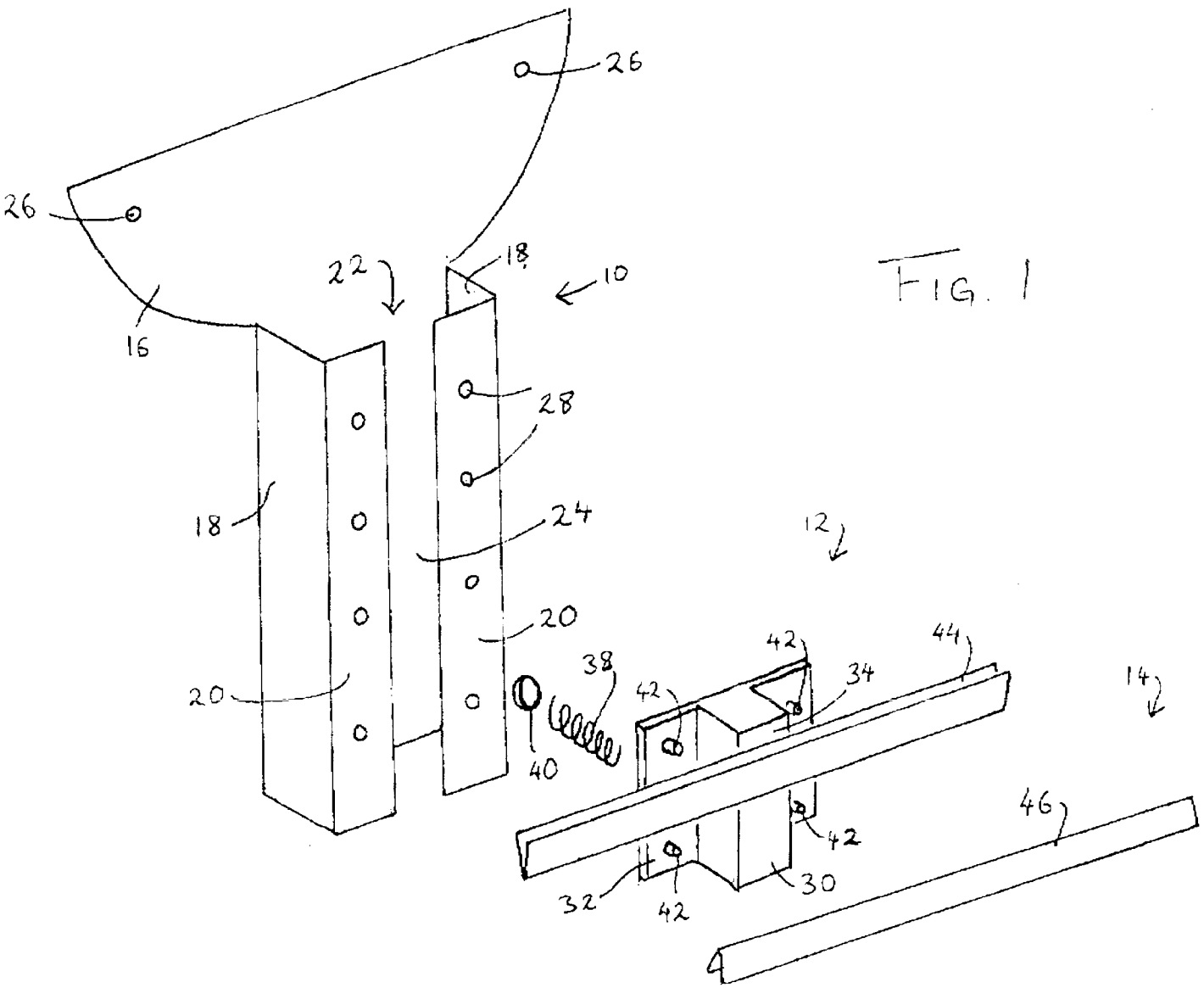
FIG. 1 is an exploded view of a device according to a first embodiment of the invention.
Figure 2:
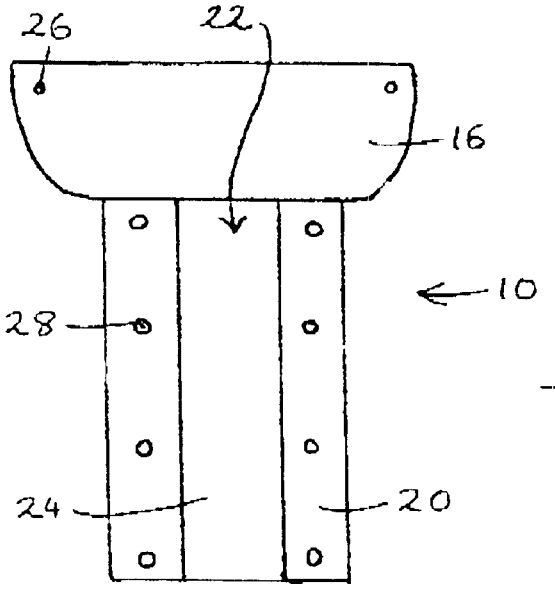
FIG. 2 is a front view of a first component forming part of the device of FIG. 1.
Figure 3:
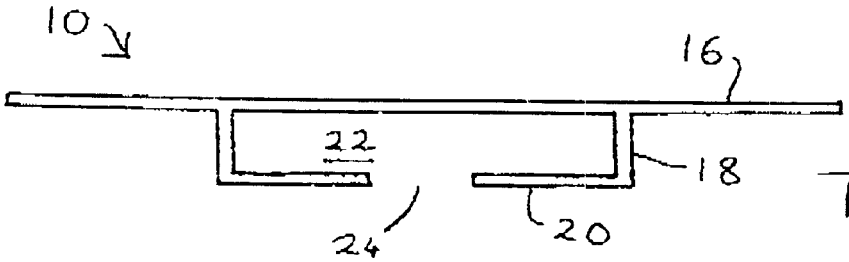
FIG. 3 is a top view of the first component of FIG. 2.
Figure 4:
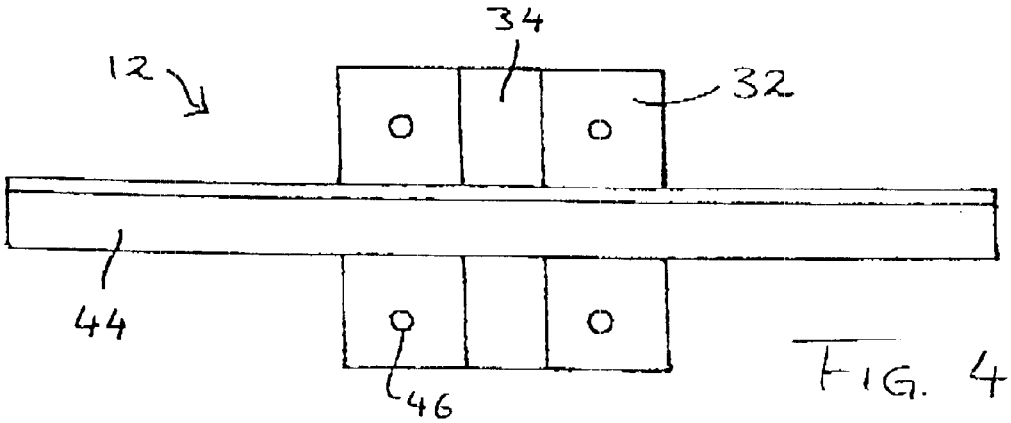
FIG. 4 is a front view of a second component forming part of the device of FIG. 1.
Figure 5:
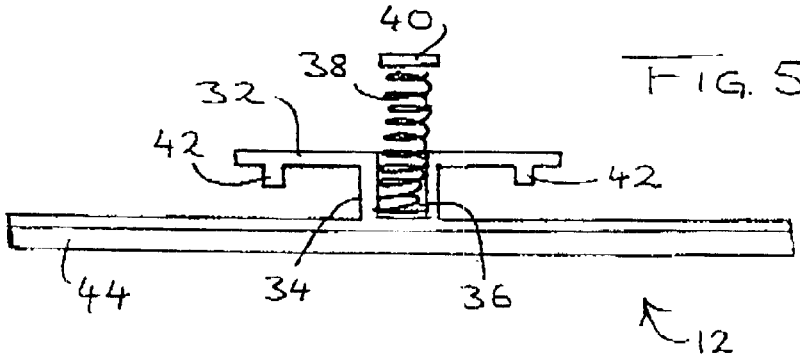
FIG. 5 is a top view of the second component of FIG. 4.
Figure 6:
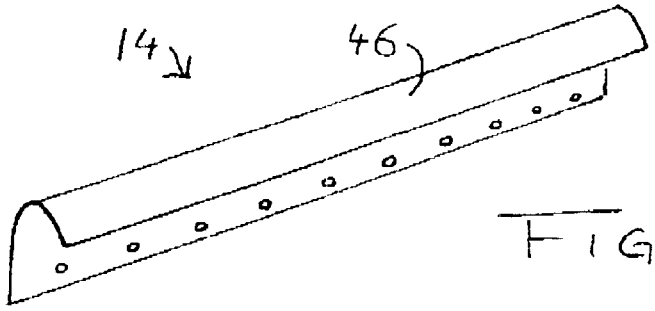
FIG. 6 is a perspective view of a third component forming part of the device of FIG. 1.

A bore 36, FIGS. 5 and 7, is provided in the rear of the member 30 to accommodate a compression spring 38. A leaf spring could alternatively be used. The rear end of the spring 38 bears, via a cap or cushion 40, on the back plate 16 to resiliently bias the plate 32 towards the front walls 20 of the channel 24. The front surface of the plate 32 has four forwardly projecting studs 42 whose horizontal and vertical spacing is substantially the same as that of the holes 28 in the front walls 20. Thus, at any vertical position of the element 30 in the channel 24 where the four studs 42 are in register with four of the holes 28, the forward biasing action of the spring 38 will cause the four studs 42 to enter the four holes 28 and retain the element 30 at that vertical position.

However, by pushing the member 30 rearwardly against the bias of the spring 38 the studs 42 will disengage the holes 28 to allow the member 30 to be slid along the channel 24 to a position where the four studs 42 are in register with a different set of four holes 28. Then, if the member 30 is released at that point, the spring 38 will bias the studs 42 into engagement with the new set of four holes 28 so that the member 30 will be retained at the new vertical position.

The second component 12 further includes a substantially horizontal rail 44 fixed to the front surface of the body 34. The rail 44 has a generally V-shaped cross-section, the mouth of the "V" facing upwards.

The third component 14 is a further rail 46, also having a generally V-shaped cross section. In use the rail 46 is fixed to the rear of a picture 50 (FIG. 7) to be hung, for example by nails or tacks, with the rail substantially parallel to the top edge of the picture and with the mouth of the "V" facing down.

In practice, the third component can be supplied as a long rail and cut to size to accommodate different picture widths, or it can be of a single standard length.

In use of the device, the back plate 16 is fixed to the wall with the channel 24, having the element 30 and spring 38 slidably accommodated therein, substantially vertical. The position of the member 30 is preferably adjusted so that initially it is at the top of the channel 22, i.e. the four studs 42 engage the topmost four holes 28. The rail 46 is fixed to the rear of the picture 50 as described above. The picture is then lifted and placed on the device such that the downward facing rail 46 on the rear of the picture engages the upward facing rail 44 carried on the front of the body 30, the two rails being substantially parallel. The picture is now supported on the wall with its top surface substantially horizontal.

To adjust the vertical position of the picture 50, the edges of the picture are grasped and the picture is pushed towards the wall to correspondingly push the element 30 against the spring 38 and disengage the studs 42 from the holes 28. The picture is now slid downwardly, the engagement of the rails 44, 46 causing the member 30 to likewise slide in the channel 22. When the picture is at the correct height, it is released to allow the spring 38 to push the member 30 once again towards the front walls 20 so that the studs 42 now engage a new set of four holes 28. If the studs are not properly aligned with the holes, a slight adjustment of the picture will be necessary. In order to allow upward adjustment of the height of the picture without removing the picture from in front of the device, the body 30 has a forward projection 60, FIG. 7, which can be temporarily engaged by the rail 46 during upward sliding of the picture. Having adjusted the height of the picture, the horizontal position is simply adjusted by sliding the rail 46 along the length of the rail 44.

Figure 8:
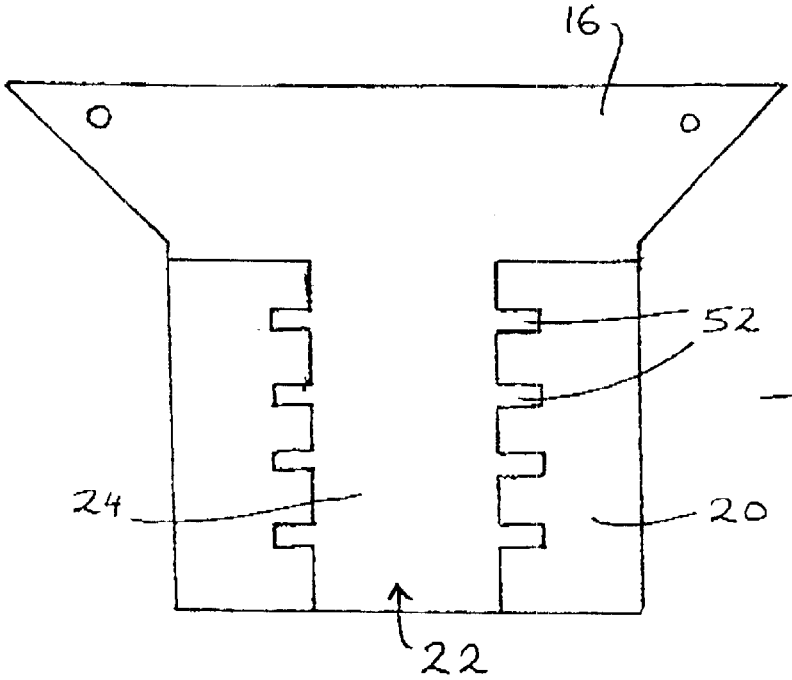
FIG. 8 is a front view of a first component forming part of a device according to a second embodiment of the invention.
Figure 9:
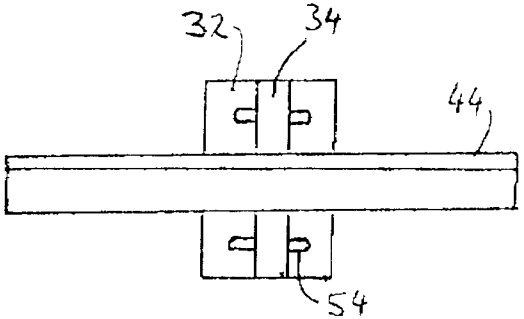
FIG. 9 is a front view of a second component corresponding to the first component of FIG. 8.

Various modifications of the above device are possible. For example, as seen in FIG. 8, the holes 28 in the front walls 20 of the channel 22 may be replaced by rectangular recesses 52 evenly spaced along the length of the free edges of the front walls 20. In such case the plate 32 would have lateral teeth 54, FIG. 9, correspondingly spaced to engage such recesses at different positions along the channel. Also, the compression spring 38 may be replaced by a leaf spring or other resilient biasing arrangement. Further, the rail 46 may be provided in various lengths to accommodate various widths of picture, or it may have lines of weakening along its length to allow the correct length to be broken off.

The advantages of the device are that the picture is always held level and can easily be adjusted both vertically and horizontally without removing it from the wall. Thus less skill is required in hanging pictures and it is easier to group pictures together in desired positions.

Of course, the device may be used to hang objects other than pictures on a wall, and the rail 46 and/or 44 may be replaced by support devices appropriate to the object concerned.

In addition, while the device described has the intermediate or second component 12 adjustable vertically relative to the wall with the picture adjustable horizontally relative to the component 12, it is possible to device embodiments in which the intermediate component moves horizontally relative to the wall and the picture is adjusted vertically relative to the intermediate component.

The invention is not limited to the embodiments described herein which may be modified or varied without departing from the scope of the invention.

What is claimed is:

1. A device for hanging an object on a wall, the device comprising a first component including a guide for mounting on the wall, a second component including an element for slidably engaging the guide for movement thereon along a first direction, and a third component for engaging the second component and being adjustable thereon along a second direction substantially normal to the first direction, the object being attached in use to the third component, the first and second components having respective formations on the element and guide which can releasably engage one another at different positions of the element along the guide, the device further including means acting on the element in a direction away from said wall on which the first component is mounted in use for resiliently biasing said formations into engagement to retain the element at a selected position along the guide, the arrangement being such that the element may be pushed towards the wall to disengage said formations to allow the element to be slid along the guide to another position.

2. A device as claimed in claim 1, wherein the guide comprises a channel having a longitudinal opening of restricted width to retain the element within the channel, the opening, in use of the device, facing away from the wall, the resilient biasing means biasing the element towards the longitudinal opening and the guide having a plurality of said formations along or adjacent to the longitudinal opening.

3. A device as claimed in claim 1, wherein the second component further includes a rail carried by and extending substantially normal to the direction of movement of the element, the third component being adjustable along the length of the rail.

4. A device as claimed in claim 3, wherein the third component includes a second rail which may engage and be supported by the first rail parallel thereto.

* * * * *